US007241233B2

(12) United States Patent
Sato et al.

(10) Patent No.: US 7,241,233 B2
(45) Date of Patent: Jul. 10, 2007

(54) GOLF BALL

(75) Inventors: Katsunori Sato, Chichibu (JP); Atsuki Kasashima, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 10/829,471

(22) Filed: Apr. 22, 2004

(65) Prior Publication Data

US 2005/0239579 A1 Oct. 27, 2005

(51) Int. Cl.
*A63B 37/12* (2006.01)

(52) U.S. Cl. ..... 473/383

(58) Field of Classification Search ..... 473/378–385
See application file for complete search history.

(56) References Cited

U.S. PATENT DOCUMENTS 6,290,615 B1 9/2001 Ogg
2003/0158002 A1* 8/2003 Morgan et al. ..... 473/383

* cited by examiner

*Primary Examiner*—Raeann Trimiew
(74) *Attorney, Agent, or Firm*—Sughrue Mion, PLLC

(57) ABSTRACT

A golf ball having a surface on which are formed numerous dimples and numerous edges which define the dimples is characterized in that the edges are composed of a plurality of edge elements, and the dimples include dimples which are defined by a plurality of edge elements and are non-circular as viewed from above. Dimple effects on the golf ball enhance the aerodynamic performance, enabling the ball to achieve an increased carry.

27 Claims, 6 Drawing Sheets

GOLF BALL

BACKGROUND OF THE INVENTION

The present invention relates to a golf ball having an excellent flight performance.

It is well-known that, in a golf ball, the high rebound of the ball itself and the air resistance-reducing effects during flight by dimples arranged on the ball's surface play important roles in enabling the ball to achieve a long carry when hit. A variety of methods have been devised for arranging dimples as densely and uniformly as possible on the surface of the ball so as to reduce air resistance.

As shown in FIG. 11, the dimples s used on a golf ball G are generally in the shape of depressions that are circular as viewed from above. Even if, in order to arrange such circular dimples s to a high density, neighboring dimples are placed so closely to each other that the width of the land t separating two dimples approaches zero, lands of a certain size having triangular or quadrangular shapes of a certain extent are formed in areas surrounded by three or four thusly arranged dimples. Also, because it is critical to arrange dimples as uniformly as possible on the spherical surface of the ball, some degree of compromise on the density of the arrangement of circular dimples s has been required.

To arrange the dimples both uniformly and to a high density, dimple configurations have been adopted in which from two to five types of dimples of differing diameter are arranged on the spherical surface of the ball in the manner of a regular octahedron or a regular icosahedron.

However, so long as only circular dimples are used, the practical upper limit in dimple surface coverage, which is the total surface area of the dimples as a proportion of the total surface area of the sphere, is about 75% (which corresponds to a land surface coverage of about 25%).

Unlike the dimples described above, U.S. Pat. No. 6,290,615 discloses a golf ball in which projections that extend out on a lattice (lattice members) are disposed over a smooth spherical surface, partitioning the surface into hexagonal shaped bounded areas and thereby enclosing land surfaces.

However, the hexagonal shaped bounded areas delineated by the lattice members lie on a spherical surface having a center that coincides with the center of the ball and are not dimples, thus having a poor air resistance lowering effect.

SUMMARY OF THE INVENTION

Therefore, the object of the present invention is to provide a golf ball in which the aerodynamic performance is enhanced by dimple effects, enabling an increased carry to be achieved.

The inventors have conducted extensive investigations to achieve the above objects. As a result, by including among the dimples provided on the surface of the ball dimples which are delineated by edges composed of a plurality of edge elements and which are non-circular dimples as viewed from above that are formed by the joining together of these edge elements, the inventors were able to enhance the aerodynamic performance of the ball and increase its carry.

The dimple surface coverage contributes significantly to the flight characteristics of a golf ball; a larger surface coverage confers a better aerodynamic performance. The present invention focuses on the shape of the dimple edges. By giving the dimples enclosed by these edges unusual shapes and arranging them on the ball's surface, it was possible to increase the dimple surface coverage, enabling the carry of the ball to be increased.

Accordingly, the invention provides the following golf balls.

(1) A golf ball having a surface on which are formed numerous dimples and numerous edges that define the dimples, characterized in that the edges are composed of a plurality of edge elements and the numerous dimples include dimples which are defined by a plurality of edge elements and are non-circular as viewed from above.

(2) The golf ball of claim 1, wherein at least 80% of all the edges defining the plurality of dimples have a cross-sectional shape that is substantially the same.

(3) The golf ball of claim 1, wherein the edges have a cross-sectional shape that is circularly arcuate.

(4) The golf ball of claim 3, wherein the circularly arcuate cross-sectional shape is formed at a radius of curvature of 0.2 to 2.0 mm.

(5) The golf ball of claim 1, wherein the edges are formed at positions within a range of 0.01 to 0.2 mm from an outer circumferential surface toward a center of the ball.

(6) The golf ball of claim 1, wherein the edge elements include edge elements which have shapes as viewed from above that are curvilinear.

(7) The golf ball of claim 6, wherein the edge elements additionally include edge elements which have shapes as viewed from above that are rectilinear.

(8) The golf ball of claim 6, wherein the edge elements have shapes as viewed from above that are circularly arcuate and wherein a plurality of the edge elements are interconnected to form dimples having shapes as viewed from above that are substantially circular.

(9) The golf ball of claim 8, wherein a plurality of the circularly arcuate edge elements and the rectilinear edge elements are combined to form dimples having shapes as viewed from above that are non-circular.

(10) The golf ball of claim 6, wherein the edge elements having shapes as viewed from above that are curvilinear are combined to form dimples having shapes as viewed from above that are non-circular.

(11) The golf ball of claim 8, wherein a plurality of the curvilinear edge elements and the rectilinear edge elements are combined to form dimples having shapes as viewed from above that are non-circular.

DETAILED DESCRIPTION OF THE INVENTION

The golf ball of the present invention is described in detail below in conjunction with the accompanying drawings.

Figure 1:
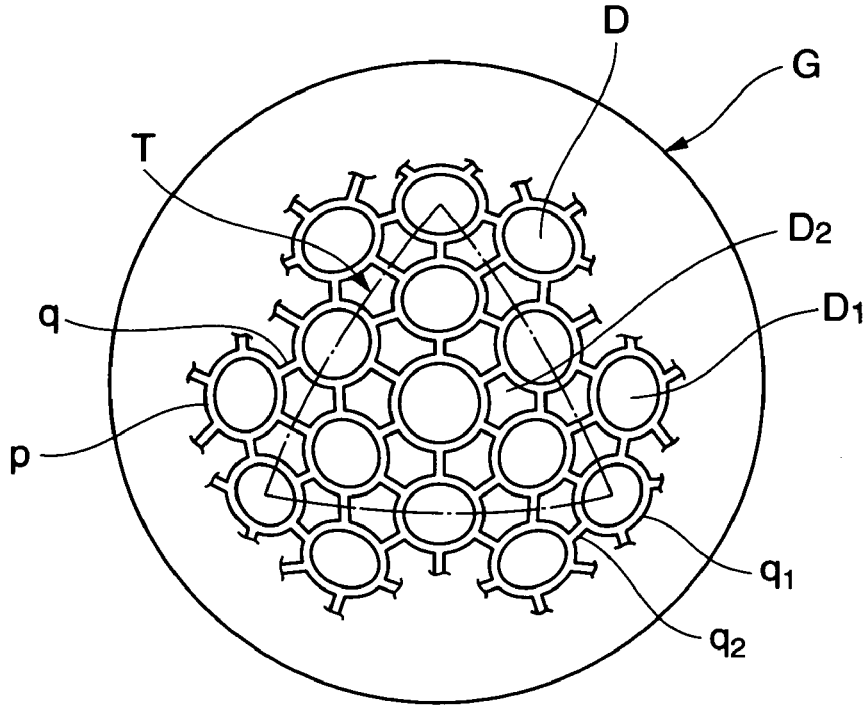
FIG. 1 is a schematic plan view of a golf ball illustrating a first embodiment of the invention.
Figure 2:
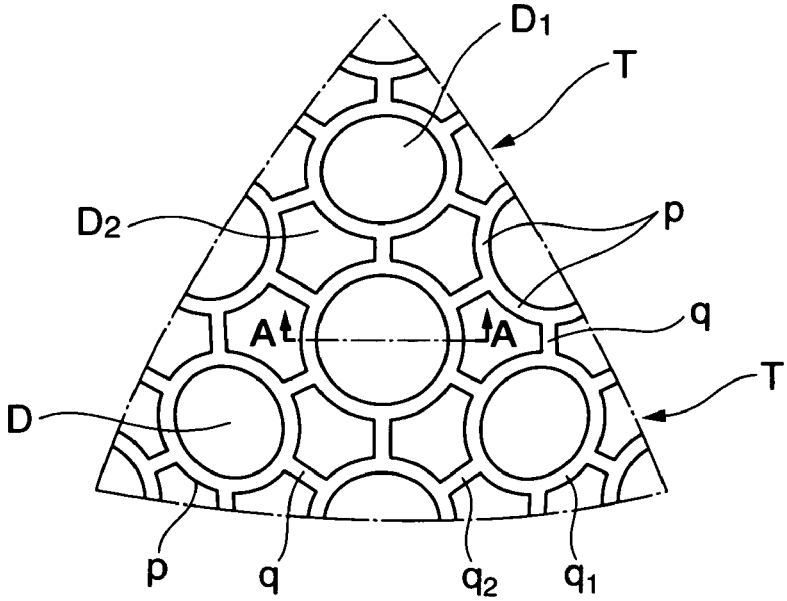
FIG. 2 is an enlarged view of a portion of the ball surface shown in FIG. 1.
Figure 3:
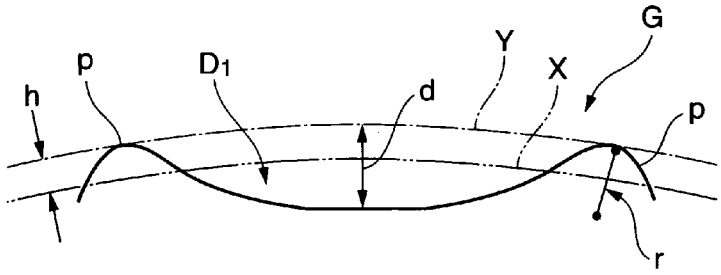
FIG. 3 is a cross-section taken along line A-A in FIG. 2.
Figure 4:
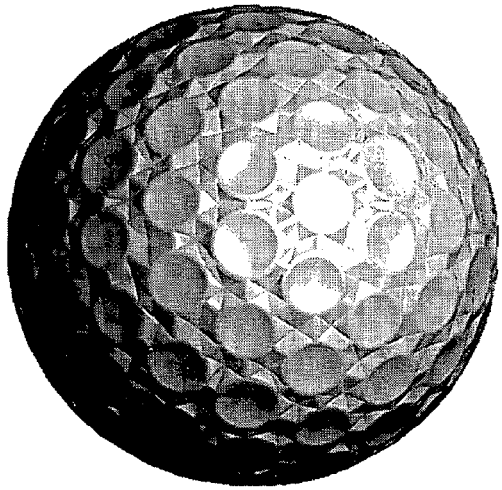
FIG. 4 is a photograph of the golf ball according to the first embodiment.

FIG. 1 is a plan view of a golf ball illustrating a first embodiment of the invention, FIG. 2 is an enlarged view of the center portion of FIG. 1, FIG. 3 is a cross-section taken along line A-A in FIG. 2, and FIG. 4 is a photograph of the golf ball according to the same embodiment.

The invention is characterized in that, as shown in FIG. 1, the surface of the ball is provided with numerous dimples D. Edges p are composed of a plurality of edge elements, specifically curvilinear edge elements $q_1$ and rectilinear edge elements $q_2$. Included among the dimples D are dimples $D_2$ which are formed by the connection of these edge elements and have a shape as seen from above that is non-circular.

In this embodiment, the dimples D consist of circular dimples $D_1$ having a shape as seen from above that is circular (referred to below as simply "circular dimples") and non-circular dimples $D_2$ having a shape as seen from above that is non-circular (referred to below as "non-circular dimples"). Concerning the edge elements q of which the dimple edges p are composed, specific reference can be made to the cross-sectional diagram shown in FIG. 3. That is, dimple edges p are formed within bounds set by an outermost circumferential surface Y (denoted by a single dot-and-dashed line) situated on a ball G and defined by interconnecting the apices of the dimple edges p, and a baseline X (double dot-and-dashed line) drawn at points located a distance h toward the center of the ball G from the outer circumferential surface Y and concentric to an extension of surface Y. The distance h is in a range of 0.01 to 0.20 mm. The dimple edges p have cross-sectional shapes which, although not subject to any particular limitation, are such that when the dimple edges p are described by circular arcs of radius r, e.g., a radius r of 1 mm, about centers located inside the ball G and a dimple D, in a segment connecting the left and right edges p with the deepest part of the dimple, is described by a large circular arc about a center located outside the ball, the lower ends, or baseline X (double dot-and-dashed line) positions, of the edges p are points of inflection of the circular arcs of the radius r and the large circular arc. In FIGS. 1 and 2, the curvilinear edge elements $q_1$ and rectilinear edge elements $q_2$ drawn as the above-described edges p represent the contours, as viewed from above, of the edges p at the baseline X positions shown in FIG. 3. When the edges p have cross-sectional shapes that are in the form of circular arcs, the radius r is preferably 0.2 to 2.0 mm, and most preferably 0.5 to 1.5 mm.

In the invention, it is preferable for at least 80% of all the edges p which define the dimples D to be edges of substantially the same cross-sectional shape.

In the embodiment shown in FIG. 3, the dimple D portion is a depression which begins at the apices of the edges p on the single dot-and-dashed line representing the outermost circumferential surface Y and extends to the deepest part of the dimple at about the center thereof. The dimple has a shape at the bottom which is recessed or flat. The depth d from the edge p of the dimple to its deepest part is generally at least 0.1 mm and preferably at least 0.15 mm, but generally not more than 0.5 mm, and preferably not more than 0.35 mm. At a dimple depth d of less than 0.1 mm, a dimple effect may not be obtained. On the other hand, at a depth d of more than 0.5 mm, air resistance arises, which may adversely affect the carry of the ball.

The triangular shape in FIGS. 1 and 2 represents a single unit triangle T when the ball is treated as a spherical icosahedron. For the sake of convenience, the arrangement of dimples D is shown here only for the unit triangle T and its immediate vicinity. In the invention, the edges p are composed, in the manner of this embodiment, of a plurality of edge elements q and preferably include curvilinearly extending elements $q_1$. In the present embodiment, six circularly arcuate edge elements are connected as curvilinear edge elements $q_1$ to form one circular dimple $D_1$ and, in a space surrounded by three circular dimples $D_1$, three curvilinear or circularly arcuate edge elements $q_1$ and three rectilinear edge elements $q_2$ are combined to form a non-circular dimple $D_2$. In each of these dimples $D_1$ and $D_2$, the deepest part of the dimple is located at the center of the respective dimple.

The arrangement of the circular dimples $D_1$ is described. A single circular dimple $D_1$ is disposed at the center of the unit triangle T, and three other circular dimples $D_1$ are disposed at the respective vertex positions of the same unit triangle in such a way that each vertex of the unit triangle T coincides with the center of one of the dimples. Three additional circular dimples $D_1$ are disposed between the circular dimple positioned at the center of the unit triangle T and the circular dimples centered at the respective vertices of the triangle. In addition, three more circular dimples $D_1$ are respectively disposed at center positions on each side of the unit triangle in such a way that the center of each dimple lies on a different side of the triangle. These circular dimples $D_1$ are interconnected by rectilinear edge elements $q_2$, thereby forming non-circular dimples $D_2$ in spaces enclosed by three of the circular dimples $D_1$.

The dimple arrangement described above is based on a spherical icosahedron, although other arrangements, including spherical dodecahedrons and spherical octahedrons, may be suitably used.

The total number of dimples formed on the surface of the ball is at least 100, and preferably at least 250, but not more than 500, and preferably not more than 450.

The space occupied by the dimples as a percentage of the total volume of the ball is described while referring to FIG. 3. The sum of the dimple spaces enclosed by the outer circumferential surface of the ball and the dimple depressions, when expressed as a percentage of the volume of a phantom sphere represented by the surface of the ball were it to be free of dimples (which ratio is referred to hereinafter as the "dimple space occupancy"), is set in a range of generally at least 1.1%, preferably at least 1.2%, and more preferably at least 1.25%, but not more than 1.6%, preferably not more than 1.55%, and even more preferably not more than 1.5%. By setting this dimple space occupancy within the above range, the golf ball, when hit with a driver or other club for providing a long carry, can be prevented from describing too steep an arc in flight or from descending too soon without achieving enough loft.

Figure 5:
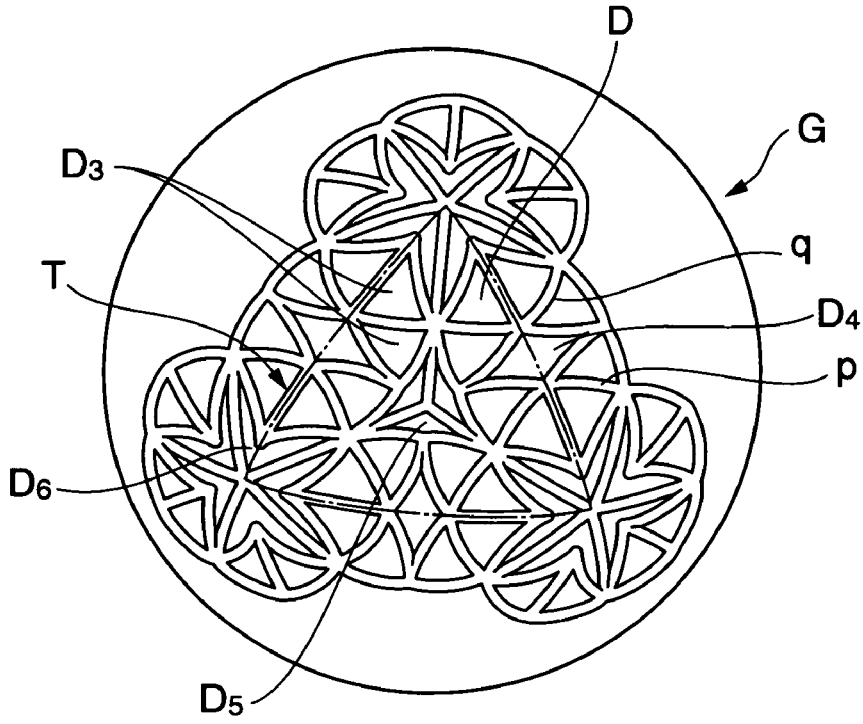
FIG. 5 is a schematic plan view of a golf ball illustrating a second embodiment of the invention.
Figure 6:
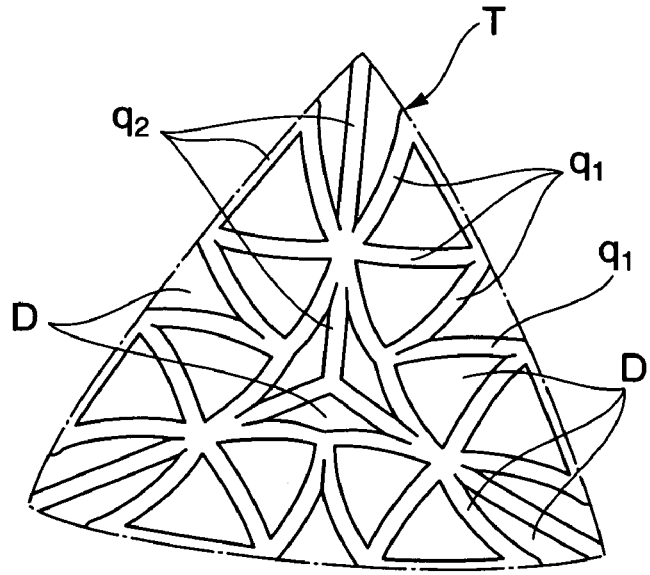
FIG. 6 is an enlarged view of a portion of the ball surface shown in FIG. 5.
Figure 7:
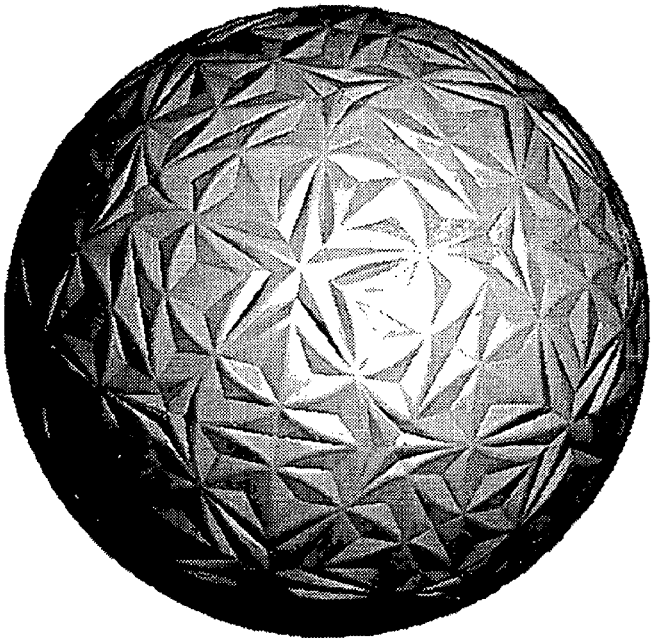
FIG. 7 is a photograph of the golf ball according to the second embodiment.

FIG. 5 is a schematic top view showing a second embodiment of the golf ball according to the invention, FIG. 6 is an enlarged view of a portion of FIG. 5, and FIG. 7 is a photograph of the golf ball according to this embodiment.

The golf ball according to the second embodiment includes curvilinear edge elements $q_1$ and rectilinear edge elements $q_2$ as edges p which demarcate dimples. These edge elements form a large number of various types of non-circular polygonal dimples, including those denoted as $D_3$, $D_4$, $D_5$ and $D_6$.

As in the first embodiment, the dimples in this embodiment have a configuration based on a spherical icosahedron.

FIG. 5 is intended to show primarily the dimples arranged within a unit triangle T delineated by single dot-and-dashed lines, and omits most other dimples. However, the overall manner in which the dimples are arranged can be appreciated from the photograph of a golf ball shown in FIG. 7.

The dimple arrangement is now described in greater detail. Groups of substantially petaloid non-circular dimples $D_6$ are formed at the position of each vertex of the unit triangle T from ten curvilinear edge elements $q_1$ and five rectilinear edge elements $q_2$. One-fifth of each group lies within a single unit triangle T. A non-circular dimple $D_4$ of a shape other than petaloid is formed at the center of each side of the unit triangle T from four curvilinear edge elements $q_1$. One-half of each such dimple lies within a single unit triangle T. Three non-circular dimples $D_5$ are formed at the center of the unit triangle T from three rectilinear edge elements $q_2$ and six curvilinear edge elements $p_1$. The region within a single unit triangle T includes, in addition to the regions occupied by the dimple groups described above, a total of 12 dimples in groups composed of non-circular dimples enclosed by three curvilinear edge elements $q_1$ and non-circular dimples enclosed by two curvilinear edge elements $q_1$ and one rectilinear edge element $q_2$. The foregoing curvilinear edge elements $q_1$ are edge elements having a shape as viewed from above which is slightly curved.

Figure 8:
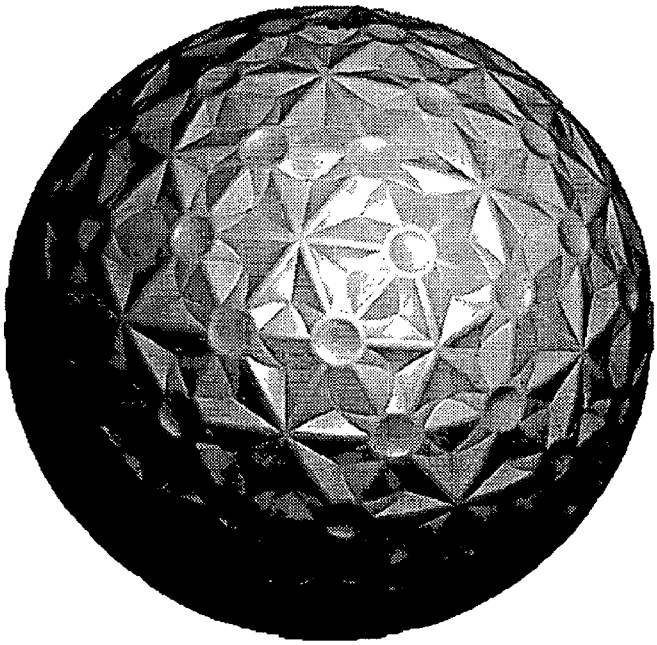
FIG. 8 is a photograph of the golf ball according to a third embodiment of the invention.

FIG. 8 is a photograph of a golf ball according to a third embodiment of the invention. This embodiment, like the first embodiment, is based on a combination of circular dimples and non-circular dimples. However, circular dimples of a relatively small diameter are used, and the non-circular dimples occupy a larger region than in the first embodiment.

Figure 9:
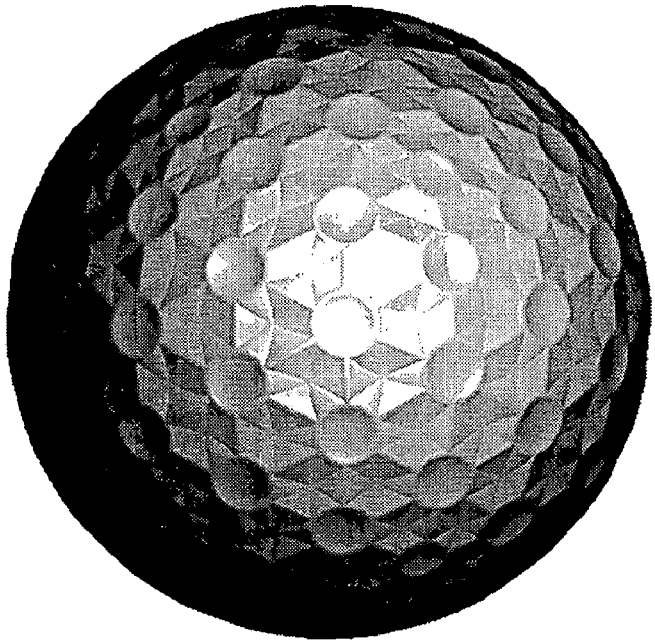
FIG. 9 is a photograph of the golf ball according to a fourth embodiment of the invention.

FIG. 9 is a photograph of a golf ball according to a fourth embodiment of the invention. The golf ball of this embodiment, like the third embodiment, is based on a combination of circular dimples and non-circular dimples. The circular dimples and non-circular dimples have sizes which are about midway between the sizes of the dimples in the first and third embodiments, and the region occupied by the non-circular dimples is larger than in the first embodiment but smaller than in the third embodiment.

The invention is not subject to any particular limitation with regard to the construction of the ball, and can be applied to all types of golf balls, including solid golf balls such as one-piece golf balls, two-piece golf balls and multi-piece golf balls having three or more layers, as well as thread-wound golf balls. Particularly advantageous use can be made of a multilayer construction like that shown in FIG. 10 having a solid elastic core and a cover with one or more intermediate layer disposed therebetween. The construction shown in FIG. 10 includes an elastic core 1, an intermediate layer 2, and a cover 3.

Figure 10:
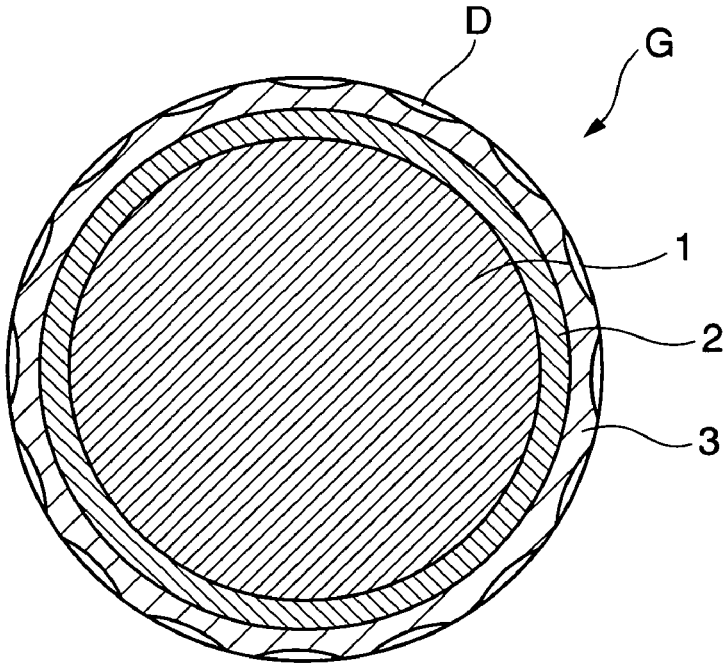
FIG. 10 is a cross-sectional view showing the internal construction of a golf ball.

In the golf ball G shown in FIG. 10, the elastic core 1 is composed primarily of polybutadiene. No particular limitation is imposed on the compressive deflection when the solid core is subjected to a load of 1,274 N (130 kgf) from an initial load state of 98 N (10 kgf). However, the solid core generally has a hardness such that the deflection under these conditions is at least 2.0 mm, and preferably at least 2.5 mm, but not more than 4.5 mm, and preferably not more than 4.0 mm.

The cover 3 may be suitably made of a known thermoplastic or thermoset polyurethane resin, and the intermediate layer 2 may be suitably made of an ionomer resin.

The cover is not subject to any particular limitation with regard to Shore D hardness. However, to provide the ball with a good spin rate and rebound, the cover has a Shore D hardness of generally at least 45, and preferably at least 50, but not more than 75, and preferably not more than 63.

Likewise, although no particular limitation is imposed on the Shore D hardness of the intermediate layer, to provide the ball with a good spin rate and rebound, the intermediate layer has a Shore D hardness of generally at least 45, and preferably at least 50, but not more than 70, and preferably not more than 60.

Although the thicknesses of the cover and the intermediate layer are not subject to any particular limitations, it is preferable for the cover to have a thickness of 1.0 to 1.5 mm and for the intermediate layer to have a thickness of 1.0 to 2.0 mm. Ball specifications such as weight and diameter may be set as appropriate under the Rules of Golf.

EXAMPLES

Examples are provided below by way of illustration and not by way of limitation.

Examples and Comparative Example

Figure 11:
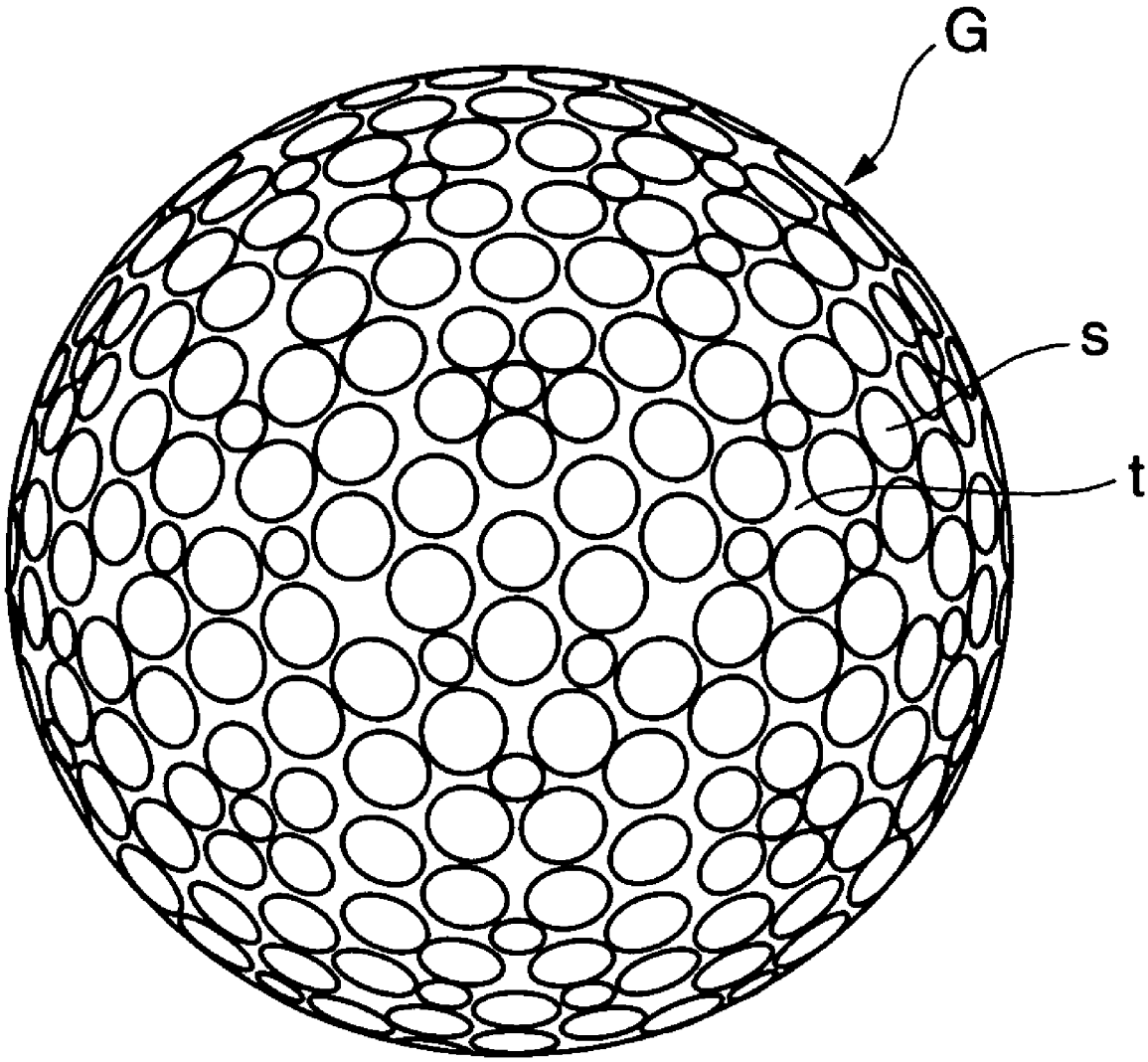
FIG. 11 is a schematic plan view of a prior-art golf ball.

Comparative tests were conducted on the flight properties of golf balls having the dimple configurations shown in Example 1 (FIG. 1), Example 2 (FIG. 5) and Comparative Example 1 (FIG. 11). The dimple configurations in Example 1 (FIG. 1), Example 2 (FIG. 5) and Comparative Example 1 (FIG. 11) were all based on a spherical icosahedron.

The golf balls in each of these examples have an interior construction like that in FIG. 10, which shows a ball G having a three-piece construction composed of a core 1, one intermediate layer 2, and a cover 3.

Core

The following ingredients were used: 100 parts by weight of polybutadiene (available from JSR Corporation under the trade name BR01), 25 parts by weight of zinc acrylate, 0.8 part by weight of dicumyl peroxide (available from NOF Corporation under the trade name Percumil D), 0.8 part by weight of 1,1-bis(t-butylperoxy)-3,3,5-trimethylcyclohexane (available from NOF Corporation under the trade name Perhexa 3M-40), 0.2 part by weight of an antioxidant (Nocrac NS-6, produced by Ouchi Shinko Chemical Industry Co., Ltd.), 25 parts by weight of zinc oxide, 0.5 part by weight of the zinc salt of pentachlorothiophenol, and 5 parts by weight of zinc stearate. Solid cores were fabricated in each example by vulcanizing the core material composed of these components in a core mold at a temperature of 160° C. for a period of 20 minutes. The core hardness was determined by measuring the compressive deflection from an initial load of 10 kgf to a final load of 130 kgf (hardness 10-130 kgf). A measurement of 3.5 mm was obtained.

Intermediate Layer and Cover

The solid core was then set in a mold and an intermediate layer was injection molded over the core to form a spherical body. The spherical body composed of the core covered by the intermediate layer was similarly set in a mold, and a cover was injection molded over the body. The intermediate layer material was a blend of Himilan 1605 (an ionomer resin made by DuPont-Mitsui Polychemicals Co., Ltd.), Dynaron E6100P (a hydrogenated block copolymer-polybutadiene made by JSR Corporation) and behenic acid (available from NOF Corporation). The cover material was a blend of Pandex T8295 (a thermoplastic polyurethane elastomer made by DIC Bayer Polymer, Ltd.) and Crossnate EM-30 (an isocyanate master batch made by Dainichi Seika Colour & Chemicals Mfg. Co., Ltd.). The intermediate layer and the cover had Shore D hardnesses of 56 and 50, respectively.

Golf Ball Tests

The resulting golf balls were measured for carry. In the tests, a driver (W#1) was mounted on a swing machine and the machine was adjusted so as to give the ball when hit an initial velocity of 45 m/s and a launch angle of 10°. The results are shown in Table 1.

TABLE 1

| | | Example | | Comparative Example |
|---|---|---|---|---|
| | | 1 | 2 | 1 |
| Dimple configuration | | FIG. 1 | FIG. 5 | FIG. 11 |
| Total number of dimples | | 360 | 270 | 432 |
| Dimple coverage (%) | | approx. 100 | approx. 100 | 78 |
| Test results | Carry (m) | 220.2 | 218.2 | 216.8 |
| | Total distance (m) | 230.0 | 228.4 | 225.3 |

The invention claimed is:

1. A golf ball having a surface on which are formed dimples and a plurality of edge elements that define the dimples, wherein;

the dimples comprise a first dimple, which is defined by ones of the plurality of edge elements, and is non-circular as viewed from above; and said first dimple is a depression which begins at apices of a pair of edge elements and extends through the lower end of each edge element to the deepest pan of the dimple at about the center thereof, wherein said depression is shaped such that there cannot be formed a circle by the intersection of any plane cutting the depression.

2. The golf ball of claim 1, wherein at least 80% of all the edge elements defining the dimples have a cross sectional shape that is substantially the same.

3. The golf ball of claim 1, wherein the edge elements have a cross-sectional shape that is circularly arcuate.

4. The golf ball of claim 3, wherein the circularly arcuate cross-sectional shape is formed at a radius of curvature of 0.2 to 2.0 mm.

5. The golf ball of claim 1, wherein the edge elements are formed at positions within a range of 0.01 to 0.2 mm from an outer circumferential surface toward a center of the ball.

6. A golf ball having a surface on which are formed dimples and a plurality of edge elements that define the dimples, wherein:

the dimples comprise first dimples which are defined by ones of the plurality of edge elements and are non-circular as viewed from above; and the plurality of edge elements include edge elements which have shapes as viewed from above that are curvilinear.

7. The golf ball of claim 6, wherein the plurality of edge elements additionally include rectilinear edge elements which have shapes as viewed from above that are rectilinear.

8. The golf ball of claim 6, wherein ones of the curvilinear edge elements have shapes as viewed from above that are circularly situate and arc interconnected to form second dimples having shapes as viewed from above that arc substantially circular.

9. The golf ball of claim 7, wherein:

ones of the curvilinear edge elements have shapes as viewed from above that are circularly arcuate and are interconnected to form second dimples having shapes as viewed from above that are substantially circular; and ones of the circularly arcuate edge elements and the rectilinear edge elements are combined to form the first dimples.

10. The golf ball of claim 6, wherein ones of the curvilinear edge elements are combined to form the first dimples.

11. The golf ball of claim 7, wherein ones of the curvilinear edge elements and the rectilinear edge elements are combined to form the first dimples.

12. The golf ball of claim 3, wherein: the cross-sectional shape that is circularly arcuate is described by a radius having the center thereof located inside the ball; and the depression is described by a substantially large circular arc about a center located outside the ball.

13. The gold ball of claim 1, wherein said tint dimple has a recessed bottom.

14. The golf ball of claim 6, wherein at least 80% of all the edge elements defining the dimples have a cross-sectional shape that is substantially the same.

15. The golf ball of claim 6, wherein the edge elements have a cross-sectional shape that is circularly arcuate.

16. The golf ball of claim 15, wherein the circularly arcuate cross-sectional shape is formed at a radios of curvature of 0.2 to 2.0 mm.

17. The golf ball of claim 6, wherein the edge elements are formed at positions within a range of 0.01 to 0.2 mm from an outer circumferential surface toward a center of the ball.

18. A golf ball having a surface on which are formed dimples and a plurality of edge elements that define the dimples, wherein;

the dimple comprise first dimples which are defined by ones of the plurality of edge elements and are non-circular as viewed from above; and the dimples are arc-shaped in a cross-section taken along a radius of the golf ball, wherein said first dimples have a recessed bottom, and wherein said first dimples are shaped such that there cannot be formed a circle by the intersection of any plane cutting the depression.

19. The golf ball of claim 18, wherein at least 80% of all the edge elements defining the dimples have a cross sectional shape that is substantially the same.

20. The golf ball of claim 18, wherein the edge elements have a cross-sectional shape that is circularly arcuate.

21. The golf ball of claim 20, wherein the circularly arcuate cross-sectional shape is formed at a radius of curvature of 0.2 to 2.0 mm.

22. The golf bail of claim 18, wherein the edge elements are formed at positions within a range of 0.01 to 0.2 mm from an outer circumferential surface toward a center of the ball.

23. The golf ball of claim 20, wherein the cross-sectional shape that is circularly arouse is described by a radius having the center thereof located inside the ball.

24. A golf ball having a surface on which are formed dimples and a plurality of edge elements that define the dimples, wherein:

the dimples comprise a first dimple, which is defined by ones of the plurality of edge elements, and is non-circular as viewed from above; and said first dimple is a depression which begins at apices of a pair of edge elements and extends through the lower end of each edge element to the deepest put of the dimple at about the center thereof;

wherein the circularly arcuate cross-sectional shape is formed at a radius of curvature of 0.2 to 2.0 mm.

25. A golf ball having a surface on which are formed dimples and a plurality of edge elements that define the dimples, wherein:

the dimples comprise a first dimple, which is defined by ones of the plurality of edge elements, and is non-circular as viewed from above; and aid firm dimple is a depression which begins at apices of a pair of edge elements and extends through the lower end of each edge element to the deepest part of the dimple at about the center thereof;

wherein the edge elements are formed at positions within a range of 0.01 to 0.2 mm from an outer circumferential surface toward a center of the ball.

26. A golf ball having a surface on which are formed dimples and a plurality of edge elements that define the dimples, wherein:

the dimples comprise first dimples which are defined by ones of the plurality of edge elements and are non-circular as viewed from above; and the dimples are arc-shaped in a cross-section taken along a radius of the golf ball, wherein said first dimples have a recessed bottom, and wherein the circularly arcuate cross-sectional shape is formed at a radius of curvature of 0.2 to 2.0 mm.

27. A golf ball having a surface on which are formed dimples and a plurality of edge elements that define the dimples, wherein:

the dimples comprise first dimples which are defined by ones of the plurality of edge elements and are non-circular as viewed from above; and the dimples are arc-shaped in a cross-section taken along a radius of the golf ball;

wherein aid first dimples have a recessed bottom; and wherein the edge elements are formed at positions within a range of 0.01 to 0.2 mm from an outer circumferential surface toward a center of the ball.

* * * * *